United States Patent [19]

Hasegawa et al.

[11] Patent Number: 4,923,099

[45] Date of Patent: May 8, 1990

[54] FASTENER ATTACHING APPARATUS

[75] Inventors: Yoshihiko Hasegawa; Noriyoshi Suyama, both of Tokyo, Japan

[73] Assignee: Scovill Japan Kabushiki Kaisha, Tokyo, Japan

[21] Appl. No.: 224,456

[22] Filed: Jul. 26, 1988

[51] Int. Cl.[5] ..... A41H 37/10

[52] U.S. Cl. ..... 227/114; 227/43; 227/149; 227/18

[58] Field of Search ..... 227/114, 147, 144, 18, 227/43

[56] References Cited

U.S. PATENT DOCUMENTS 4,606,487 8/1986 Douri ..... 227/149 X 4,615,473 10/1986 Taga ..... 227/149 X

*Primary Examiner*—Paul A. Bell

*Attorney, Agent, or Firm*—Marshall, O'Toole, Gerstein, Murray & Bicknell

[57] ABSTRACT

A fastener attaching apparatus for selectively feeding fasteners to portions of the material of clothes or the like includes hoppers for receiving fasteners, guide tracks and guide grooves for feeding fasteners, push rods for pushing fasteners, an upper mold for holding the material of clothes, and power sources that actuate the push rods for attaching fasteners to the material interposed between the upper and lower molds.

7 Claims, 9 Drawing Sheets

FASTENER ATTACHING APPARATUS

TECHNICAL FIELD OF THE INVENTION

The present invention relates to a fastener attaching apparatus, and more particularly to a fastener attaching apparatus for selectively feeding fasteners (any fasteners, irrespective of form; such as male and female fasteners, attaching members therefor, or merely ornamental fasteners) to the material of clothes or the like; and to the pusher system, transmission system, and feed system of the same.

DESCRIPTION OF THE PRIOR ART

Previously, in attaching fasteners to the material of clothes or the like, one or more fasteners (e.g. female or male snap fasteners, or either of the same with the attaching members therefor, or the like) are fed from one or more hoppers via guide tracks (chutes) to a clothes attaching position between an upper and a lower mold, where the fasteners are attached to the clothes. In such a fastener attaching apparatus, the number of fasteners capable of being fed is determined by the number of hoppers, and as only fasteners within the hoppers can be supplied, if the sort of fasteners is to be changed, the content of the hoppers should be exchanged.

In order to overcome this problem, the present applicant has previously provided, in Japanese Patent Application Publication No. 55-49163 (1980), a fastener attaching apparatus with three hoppers. In that apparatus, three hoppers are enough since fasteners of one side (attaching members in that case) can be used with either of two types of fasteners of the other side (female and male fasteners in that case), and, when different attaching members are used, the apparatus can be easily expanded to include four hoppers.

FIGS. 1—3 illustrate the apparatus shown in the Publication described above, and FIG. 4 illustrates a diagrammatic example of fasteners.

As shown in FIG. 1, snap fasteners are received in a receiving member formed between a rotating snap fastener receiver or hopper 1 and the vertical plane of a machine casing 2, and are fed to guiding plate 4, to a track connecting piece 5, to a fastener feeding track 6, and finally to an attaching position of the material of clothes 7 (i.e., the position of a caulking tool). The fasteners are fed through direction regulating grooves 3, which are formed, at equal intervals, at the outer circumferential plane facing the machine casing of the rotating hopper 1. The rotating hopper is intermittently driven in the direction of the arrow; fasteners falling by gravity in the direction of regulating groove 3 when said groove is at the lower vertical position are sequentially discharged into a guide groove 8. A screw 9 is for fixing track 6.

As shown in FIG. 2, three or more hoppers (three in the figure) are used. The fasteners to be fed can, as shown in FIG. 4, consist of a male snap 11, a female snap 10, and attaching members 12, 13 (which are of the same size and form). Supporting structures 20 and 21 are fixed to a base member (not illustrated). L-shaped supporting frames 23 and 24, respectively, are fixed to the supporting structures. Horizontal shafts 31 and 33 are pivotally mounted to the vertical portions 25 and 26 thereof, respectively, and are driven by a power source through cranks 45 and 44, respectively. One hopper 27, like the one shown in FIG. 1, is fixed to horizontal shaft 31 and two hoppers 29 and 30 are fixed to horizontal shaft 33. In FIG. 2, a track 56 corresponds to fastener feeding track 6 of FIG. 1, and extends from hopper 27 via a guide groove 28 toward a lower side (for a lower mold) of a position K. Tracks 57 and 58 extend from hoppers 29 and 30 via guide grooves 34 and 32 toward a common track 59, and track 59 extends toward an upper side (for an upper mold) of position K. FIG. 3 shows the configuration of a meeting point of tracks 57 and 58, wherein a switching piece 60 is pivotally-mounted as a fulcrum at a point 61 to switch the upper and lower tracks.

Thus, male fastener 11 may be fed from hopper 29, female fastener 10 may be fed from hopper 30, and attaching members 12 and 13 may be fed from common hopper 27. When members 12 and 13 are different from each other, another hopper may be provided in addition to hopper 27. In that case, a structure similar to 57, 58, and 59 may be used instead of track 56.

Fasteners 76 and 77 coming to position K are fed into an upper mold 74 and a lower mold 75, respectively, by push rods 72 and 73, which are fixed to a slide block 71 that is supported by guides 70, 70, as seen in FIG. 5.

One problem with the conventional apparatus described above is that when the track is switched in order to change the sort of fasteners, some fasteners used in the previous process may be stuck within the track, hence the new operation can not be immediately begun. It is necessary, instead, to perform the switching at the track outlet, resulting in complication of the mechanism. Furthermore, such a switching mechanism should be switched every time the operation is changed, thus the promptness of the operation is lost.

Another problem is that the flexibility of the apparatus according to the prior art is low. That is, it is desirable in attaching fasteners that the apparatus be capable of an arbitrary use of either manual feeding, semi-automatic feeding or the like, or automatic feeding from the hoppers; but no fastener attaching apparatus having this capacity has been provided.

In addition, in the prior art described above, when two or more hoppers are used, either electric motors are provided for each hopper for rotating the hopper shafts or two hoppers are supported on a common, rotated shaft. In the former case, however, a plurality of motors is required and in the latter case rotation of an unused hopper results in racing and the generation of powders due to the friction between the fasteners and the hopper wall. These powders prematurely contaminate the interior of the hopper or the clothes. Further, in an apparatus having a common shaft, the width of the apparatus becomes undesirably large when three or more hoppers are required.

Furthermore, in conventional apparatus, the power source is, in general, considerably far from the ram, requiring the use of a power transmission system with a long link such as a link 64. However, such a link should have a sufficiently large cross sectional area so as not to be deformed by the compressive force required for transmitting a pushing force. Such a link is heavy and has a large moment of inertia, requiring additional power to be moved. Accordingly, the object of miniaturization, lighter weight, and power saving has not been possible to achieve.

OBJECTS OF THE INVENTION

Accordingly, it is an object of the present invention to provide a fastener attaching apparatus allowing the selection of tracks and the selection of automatic, semi-automatic, or manual operation without the provision of a special track-switching mechanism; thus offering a dramatic improvement in operation efficiency.

It is another object of the present invention to provide, in a fastener attaching apparatus using a plurality of hoppers, a hopper apparatus allowing the selection of driving one or more arbitrary hoppers with other hoppers being out of operation, and thereby solving the problem of powder generation.

It is a further object of the present invention to improve the power transmission system to achieve the miniaturization, lighter weight, and power saving of a fastener attaching apparatus.

SUMMARY OF THE INVENTION

The present invention relates to a fastener attaching apparatus comprising at least one hopper; guide tracks (chutes) extending toward lower positions from said hoppers; guide grooves horizontally extending from lower end outlets of said guide tracks toward an upper mold and/or a lower mold; push rods slidable in said guide grooves for pushing fasteners from said guide track outlets into said upper mold and/or lower mold, the front ends of said rods being haltable, before operation, at positions that are closer to said mold than are said track outlets; and power sources associated with said push rods, said power sources, when operated, withdrawing the associated push rods from their positions before operation to the rear portion of said track outlets, then pushing the same toward the associated upper mold and/or lower mold, and then halting the same at said before-operation positions.

In the present apparatus, unnecessary outlets of the guide tracks are closed by the halted push rods so that fasteners that are not desired are held within the tracks, and only two feeding systems need to be operated. Thus, a special track switching mechanism becomes unnecessary and the extra labor, such as that required for the removal of fasteners at the time of switching, can be saved, and the switching between different operations can be easily performed. Furthermore, the use of one or more feeding systems from some of the hoppers, and under certain circumstances all of them, can be suspended, allowing fasteners to be fed fully-manually or semi-manually, offering an increase in flexibility.

In another aspect of the invention, a fastener attaching apparatus according to the present invention performs a fastener attaching operation by moving a movable upper mold up and down against a fixed lower mold, the movable upper mold being supported on a vertical ram, which in turn is slidably supported to a fixed base. The apparatus comprises a first link pivotally mounted at its lower end to an upper end of said ram; it also comprises a second link pivotally mounted at its lower end to another end of the first link and pivotally mounted at its upper end to the fixed base. Bending both links in a <-shape thereby causes a vertical movement of said ram. A first pulling link has one end that is coupled to a pivotally-mounted point of the first and second links, and another end that is coupled to one leg of a swinging crank that is pivotally mounted to the fixed base. A second pulling link has one end that is coupled to another leg of the swinging crank, and another end that is coupled to an output end of a power source producing a reciprocating motion. In the pulling process of the power source, a force creating tension in the second pulling link pulls the first pulling link, whereby said first and second links extend from the <-shape to a linear shape, thereby producing the fastener attaching motion.

According to the present invention, longer links in the power transmission system of the fastener attaching apparatus are only in tension during the ram process giving an attaching pressure. This allows the use of lighter weight links, and thereby achieves an object of the present invention. It will be apparent that other power transmission members, such as shorter links, cranks, and the like, may be in compression, subject to torque, or the like, without any problem.

In another aspect of the invention, the present invention provides a fastener attaching apparatus including a plurality of rotating hoppers for supplying fasteners; guide tracks extending from said hoppers toward lower positions; guide grooves horizontally extending from lower end outlets of said guide tracks toward an upper mold and a lower mold; push rods slidable within said guide grooves to feed fasteners from said guide track outlets into said upper and lower molds; and a power source reciprocating said push rods. The hoppers are driven by one or more reversible electric motors through a transmission means, said reversible motors and said transmission means being capable of driving one or more arbitrary hoppers by a selection setting means. In a preferred example of the invention, two reversible motors and four rotating hoppers are provided, each of the reversible motors being coupled to a shaft of a pair of hoppers via a transmission means. Each transmission means drives only one of a pair of hoppers, each motor being associated with the hopper shafts via unidirectional clutches. Accordingly, combinations of one of the hoppers for the upper mold, one of the hoppers for the lower mold, or two specific hoppers for the upper and lower molds can be set by the selection setting means.

According to the present invention, the driving system for the hoppers is simplified while at the same time an apparatus with high flexibility is possible. For example, in the above-described example of a 4-hopper system, totally manual operation is possible by halting all the hoppers; semi-automatic operation (fasteners being fed manually to one of the upper mold or the lower mold) is possible using a single hopper by selecting one of the four possible choices of a single motor running in one direction; and totally automatic operation (the use of hoppers for the upper and lower molds in four combinations) is possible by using both motors.

DESCRIPTION OF THE PREFERRED EMBODIMENTS

The present invention will be hereinafter described in detail with reference to the embodiments shown in the figures.

(1) Summary of the Overall Configuration

Figure 1:
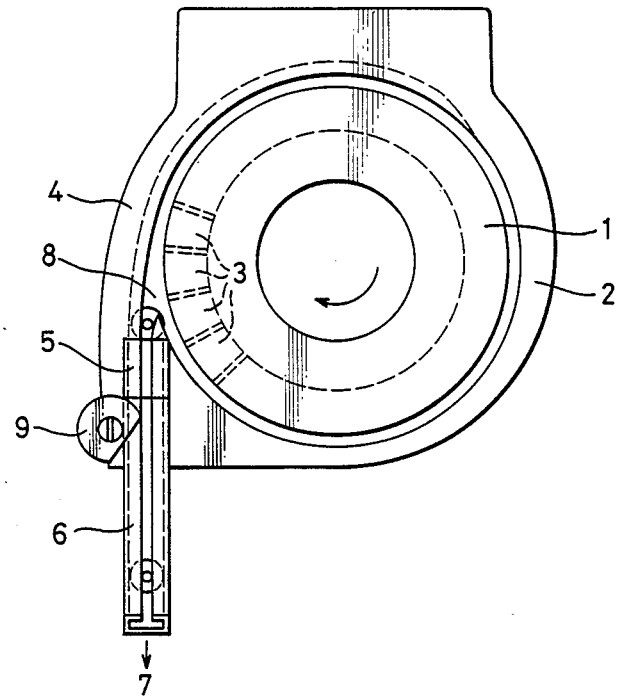
FIG. 1 is a front view illustrating the arrangement of a hopper apparatus.
Figure 3:
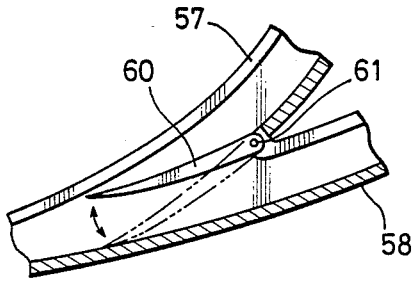
FIG. 3 is a cross-sectional view illustrating an example of a conventional fastener guide track switching mechanism.
Figure 4:
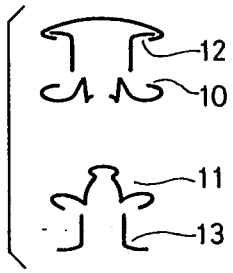
FIG. 4 is a diagrammatic view of fasteners.
Figure 7:
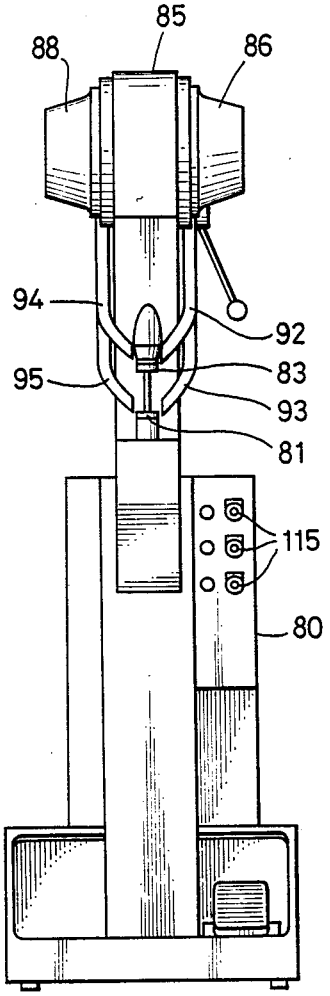
FIG. 7 is a front view of the same.
Figure 6:
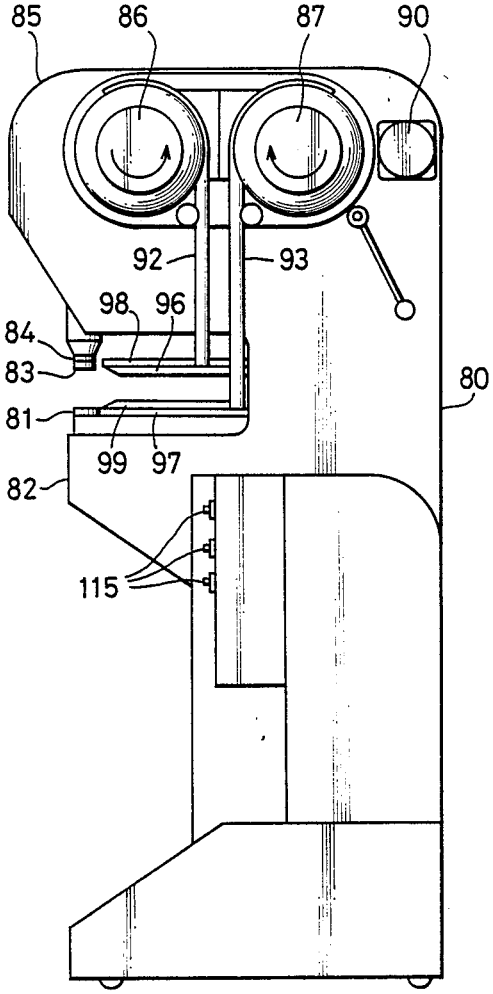
FIG. 6 is a side view of an embodiment of a fastener attaching apparatus according to the present invention.
Figure 8:
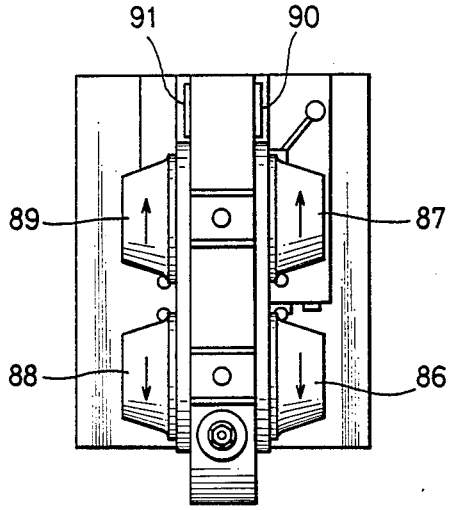
FIG. 8 is a plan view of the same.

FIGS. 6–8 illustrate an example of a 4-hopper fastener attaching apparatus utilizing the present invention, wherein a table 82 is provided on a base 80 and supports a lower mold and an upper frame 85. Upper frame 85 supports a vertical ram 84 for an upper mold 83. Faces of base 80 consist of parallel vertical planes and four hoppers 86, 87, 88, and 89, similar to that shown in FIG. 1, are provided on a portion of the upper frame 85, one pair on each side; hoppers 86 and 87 being simultaneously reversely rotated by a motor 90 and a transmission means (not illustrated), as shown in the figures, and hoppers 88 and 89, on another side, being similarly reversely rotated by a motor 91 and another transmission means (not illustrated). Fastener guide tracks 92, 93, 94, and 95 extend downward from hoppers 86, 87, 88, and 89, respectively, and open to horizontal guide grooves 96, 97, 98, and 99, respectively, to form fastener discharging outlets. Push rods (to be described hereafter) are fitted to guide grooves 96, 97, 98, and 99 so as to horizontally slide and thereby push fasteners (a generic name for male and female snaps, and attaching members of the same) fed from the guide tracks 92–95 to the upper and lower mold, respectively.

(2) Push rod mechanism

Figure 10:
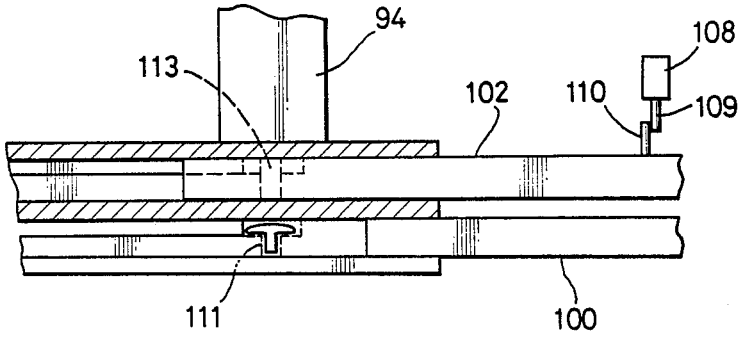
FIG. 10 is a side view illustrating the halting position of a push rod and the control switch thereof.
Figure 9:
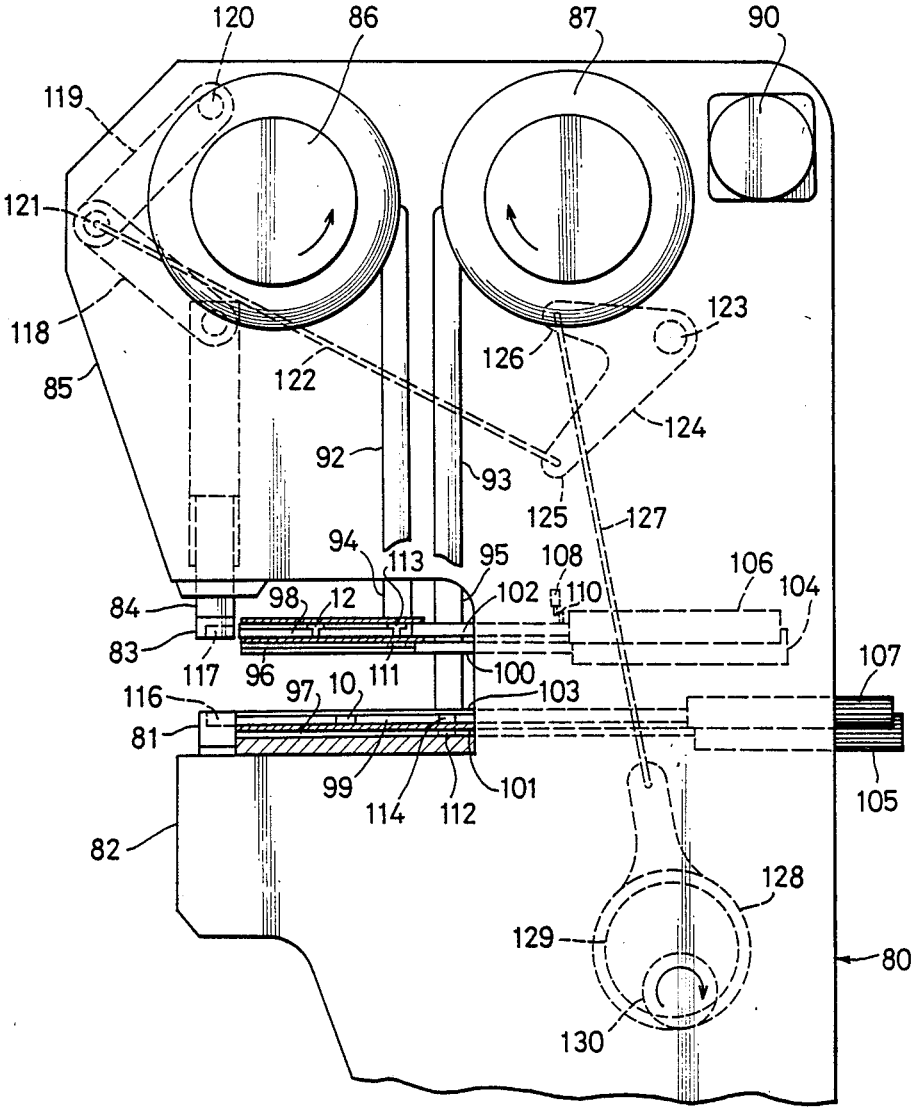
FIG. 9 is a side view illustrating in detail a principal part of the present invention.

FIGS. 9 and 10 illustrate portions related to the main points of the present invention. Push rods 100, 101, 102, and 103 are fitted to guide grooves 96, 97, 98, and 99, respectively, and rear portions of these push rods constitute pistons that can be horizontally actuated by hydraulic cylinders 104, 105, 106, and 107, respectively. A projection 110 is formed on each push rod and is contactable with an actuator 109 of a halting switch 108. (The figures illustrate this only for push rod 102.) This switch operates when push rods 100, 101, 102, and 103 retreat and the front ends of these rods come to positions obturating discharging outlets of guide tracks 111, 112, 113, and 114, as shown in FIG. 10, and acts to halt the push rods. Switch 108 is of a swing type, and is made to permit the passage of actuating projection 110 when the cylinder is forcedly actuated. Cylinders 104, 105, 106, and 107 are provided such that a pair consisting of one upper cylinder and one lower cylinder is selectively set by operating buttons 115 on an operation board (see FIGS. 6 and 7). During operation, a selected cylinder withdraws from the halting position described above and opens the discharging outlets of guide tracks 111, 112, 113, and 114 to allow discharge of fasteners (10–13), then advances and feeds the fasteners into supporting recesses 116 and 117 of molds 81 and 83, then retreats and halts at a halting position the same as that described above by switch 108. These operations may be performed by a suitable electric system.

(3) Power transmission system for a press mechanism

The ram of upper mold 84 is pivotally mounted, at an upper end, to a link 118. Link 118 is pivotally mounted to a lower end of a link 119, which in turn is pivotally mounted at an upper end to a fixed shaft 120. Links 118 and 119 thereby are capable of producing an extendible action, and of moving ram 84 up and down. A pivotally-mounted shaft 121 connecting links 118 and 119 is coupled to a front end of a lower leg 125 of a crank 124 by a long and slender metal rod link 122. Crank 124 is pivotally mounted to a fixed shaft 123 and, when rotated, causes links 118 and 119 to extend and contract. A front end of an upper leg 126 of crank 124 is coupled to a long and slender metal rod 127. Another end of metal rod 127 is coupled to an annular slide race 128. A circular shaft 129 is slidably fitted into this race, and shaft 129 is fixed to a motor shaft 130 at an eccentric position. This motor causes each downward motion of the upper mold with each pedal operation. (Under certain circumstances, the conjoint upward motion of the lower mold can be utilized.) It will be noted that the motor is capable of operation only when the push rod is in a retreated position. When the motor operates, its lowers ram 84 by a force that acts only in tension in metal rods 127 and 122. On the other hand, a pushing force is applied to the metal rods during the elevation of the ram, but the force is small. This link configuration is therefore an excellent one.

(4) Hopper mechanism

Figure 2:
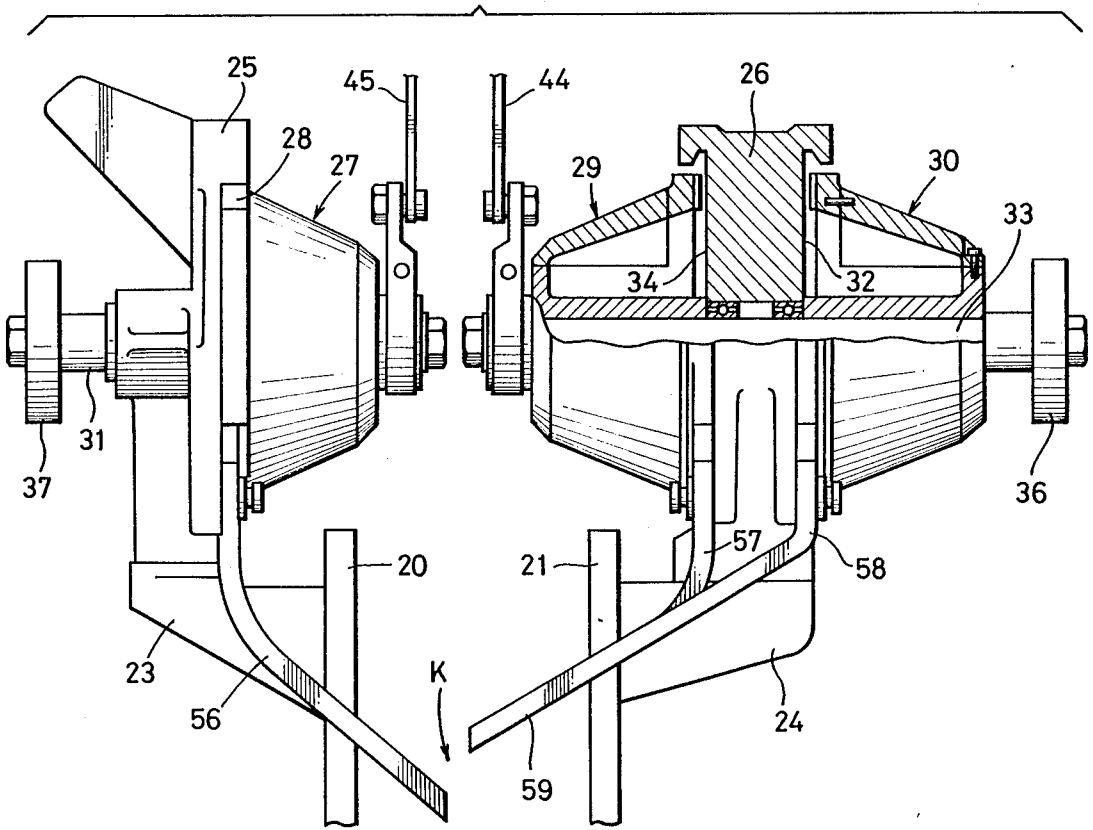
FIG. 2 is a front view illustrating, in partial cross-section, a fastener attaching apparatus according to the conventional multi-hopper method.
Figure 5:
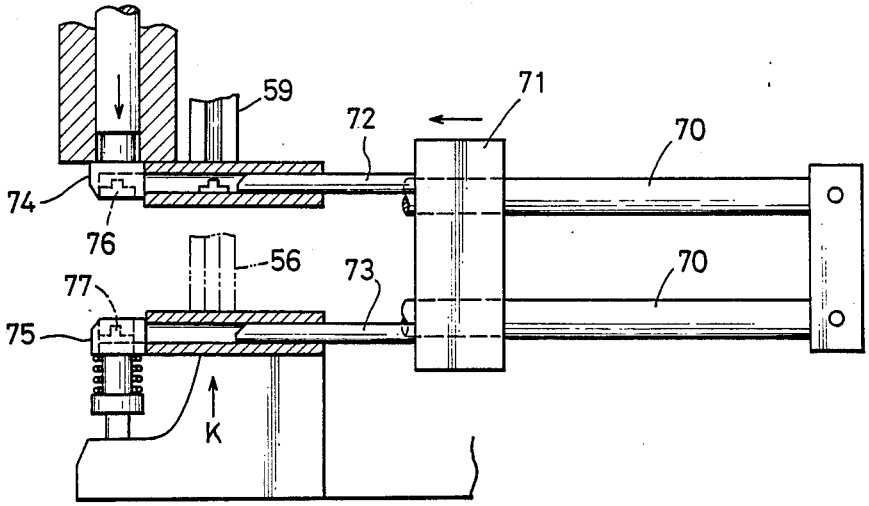
FIG. 5 is a schematic diagram of a conventional push mechanism for feeding fasteners.
Figure 16:
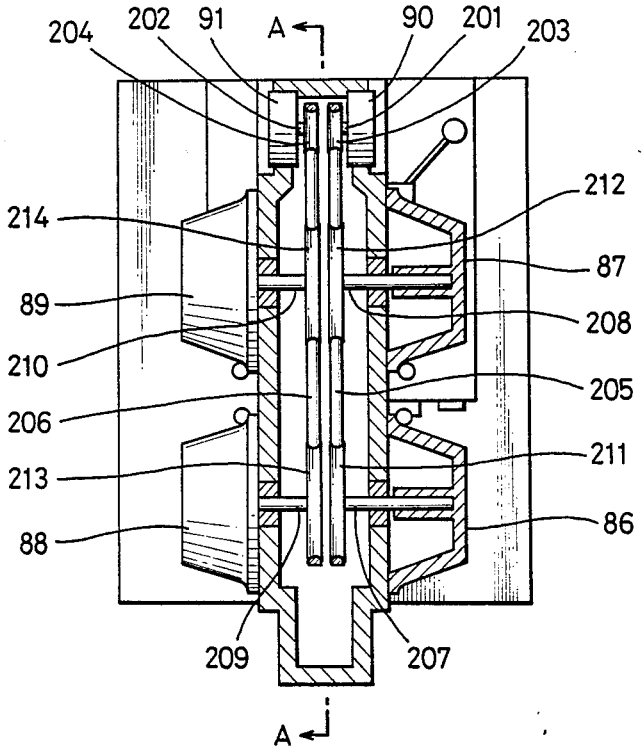
FIG. 16 is a plan view, partly in section, of an embodiment of a hopper apparatus.
Figure 17:
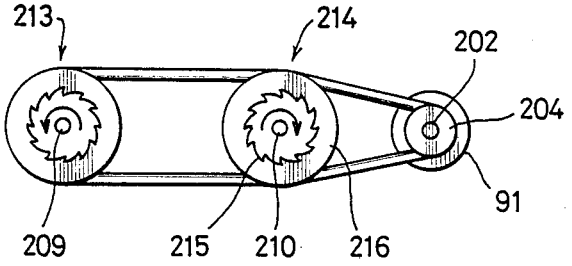
FIG. 17 is a drawing seen from A—A in FIG. 16.

It has already been described that hoppers 86 and 87 are actuated by motor 90, and hoppers 88 and 89 are actuated by motor 91, in the direction of the arrows, respectively. Previously, hoppers have been disposed along a single shaft as illustrated in FIG. 2. Such a disposition, however, results in a larger width of the apparatus, especially in a 4-hopper system. The present apparatus has a thinner configuration, as illustrated in FIGS. 16 and 17. In these figures, pulleys, i.e. pulleys for V-belts 203 and 204, are fixed to inner ends of respective output shafts 201 and 202 of motors 90 and 92 to transmit power to the hoppers 86, 87, 88, and 89 via endless V-belts 205 and 206. Hoppers 86, 87, 88, and 89 have shafts 207, 208, 209, and 210, respectively, and respective input ends have one-way clutchs 211, 212, 213, and 214. As illustrated in FIG. 17, the clutches are coupled to drive hopper 86 counterclockwise, hopper 87 clockwise, hopper 88 clockwise, and hopper 89 counterclockwise when viewed from the outside, the others being uncoupled. Each clutch can consist, for example, of both a ratchet having an inner ring 215 coupled to a hopper shaft, and of a ratchet having an outer ring 216 with a groove for the V-belt 205 or 206. Thus, the power operates one or more arbitrary hoppers by the selection of motor 90 or 91 and by the selection of the direction of rotation of the selected motor. In such a way, the selection and switching of the hoppers can be arbitrarily attained by controlling only the motors. Because there are two motors and each can be operated in two directions, four selections of a single hopper, four selections of pairs of hoppers for the upper and lower molds (either of two hoppers for the upper mold times either of two hoppers for the lower mold gives four selections), and a total halting, or nine selections in total, become possible. In such a way, the operation of a plurality of hoppers can be controlled by using reversible motors and an arbitrary selection of manual, semi-automatic, and fully-automatic operations can be accomplished by a simple switching. It will be noted that the selective setting of the motors can be performed by the operation of buttons 115. Thereby, the contamination of hoppers due to the powder generation can be minimized.

Operation

The operation of an apparatus with a configuration as described above is as follows. It is assumed that motor shaft 130 is halted in the position shown in FIG. 9, with the push rods in a halted position. First, the upper and lower mold 83 and 81 are selected in accordance with the sort of fasteners to be used, and are set to a predetermined position. Horizontal track grooves 96–99 are thereby determined. In the example illustrated in the figure, upper mold 83 associates with track groove 98, and lower mold 81 associates with track groove 99. Switch 115 (FIGS. 6 and 7) on the operation board is set to select a corresponding pair of upper and lower push rods and associated cylinders thereof. In the example of FIG. 9, push rods 102 and 103 and corresponding cylinders 106 and 107 are selected.

The operation is initiated by the main switch on the operation board. Motors 90 and 91 are thereby initiated to feed fasteners from hoppers 86–89 into guide tracks 92–99. Fasteners are fed to lower end discharging outlets 111, 112, 113, and 114. The push rods are initially at the halted positions (see FIG. 10), but the selected cylinders (106 and 107 in the present example) being actuated simultaneously or sequentially with the initiation of the motors 90 and 91 commences their withdrawal, and fasteners travel from discharging outlets 113 and 114 to horizontal guide grooves 98 and 99, but are hindered by push rods because the other cylinders are in suspension. The hydraulic pressure of the cylinders 106 and 107 is reversed, and the push rods 102 and 103 push the fasteners 12 and 10 into the recesses of the upper and lower molds 117 and 116, respectively. Push rods 102 and 103 are automatically reversed, and halt at the operation positions of the switch 108.

Then, by pressing a pedal (not illustrated), the motor shaft 130 starts operation and transmits a force consisting mainly of tension to links 119 and 121, and thus ram 84 descends and attaches the fasteners 10 and 12 to the clothes or material inserted between the upper and lower molds. The motor shaft eventually returns to the position illustrated in the figure, completing one attaching cycle.

When semi-automatic operation is required, only one feeding system, e.g. hopper 88, guide track 94, and guide groove 98, is operated before the initiation of the fastener attaching operation, and fasteners are manually supplied to the lower mold 81. The operation will be apparent from what has already been described.

Furthermore, it is also possible to stop all the fastener feeding systems for manual feeding of both the upper and lower molds.

Figure 11:
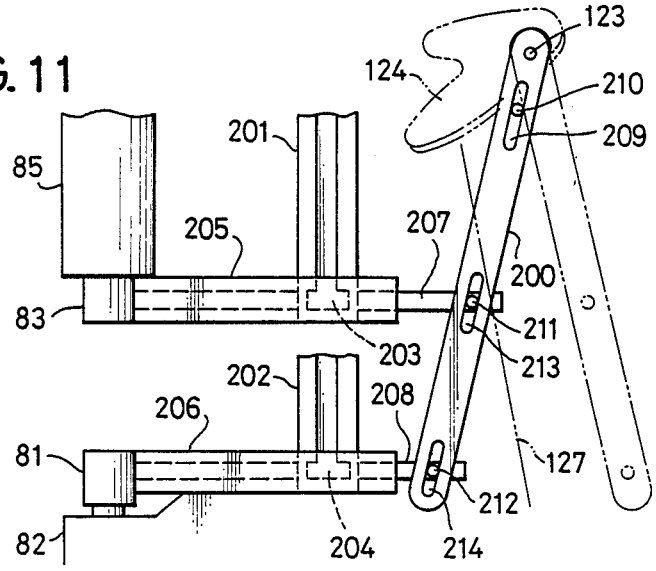
FIG. 11 is a side view of a principal part of another embodiment.

Now, another embodiment will be explained with reference to FIG. 11. This figure is basically the same as the embodiment described above except that the number of power sources and feeding systems is different. That is, instead of the piston-cylinder-type power sources 104, 105, 106, and 107 illustrated in FIG. 9, an actuating rod 200, which is pivotally mounted to the shaft 123, is used to actuate rear ends of push rods 207 and 208 of the horizontal guide grooves 205 and 206, respectively, which are bonded to discharging outlets 203 and 204 of the guide tracks 201 and 202. A slot 209 is formed near an upper end of actuating rod 200, in which a pin 210 is fitted to transmit power. Pin 210 is fixed to swinging crank 124, which in turn is actuated by tension link 127 of the power source. To rear ends of the push rods 207 and 208 are fitted pins 211 and 212, which are retractable in the direction of the axes thereof, respectively. Corresponding long and narrow slots 213 and 214 are provided to actuating rod 200 to detachably receive pins 211 and 212 therein.

Figure 12:
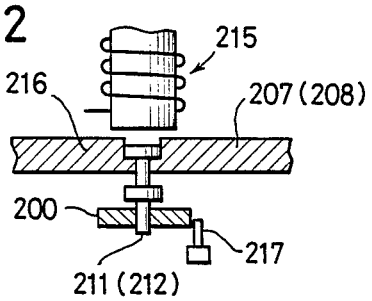
FIG. 12 is a plan view illustrating a pin actuating means.

FIG. 12 is a plan view illustrating actuating means of the pins 211 and 212, and corresponds to the condition at the moment when the halting position detecting means (108 and 109) and a swinging-type detecting means 217, shown in FIGS. 9 and 10, start operation, wherein push rod 208 (or 209) obturates discharging outlet 203 (or 204) of track 201 (or 202). At least a rear end portion of pin 211 consists of a magnetic material, and a recess 216 is formed in push rods 207 and 208 in which pins 211 and 212 are movable in the direction of their fitted axes, respectively. At the halting position of push rods 207 and 208 is disposed an electromagnetic attraction actuator 215 at positions lining up with pins 211 and 212, respectively.

Figure 13:
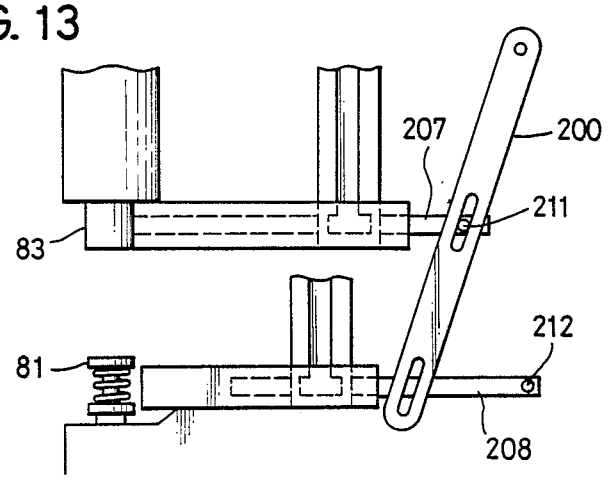
FIG. 13 is a side view illustrating one actuating condition according to this example.

The operation of this fastener attaching apparatus is almost the same as the first embodiment. With regard to the operation of the push rod, a power source common with the ram for the upper mold is used instead of a piston cylinder, and by swinging lever 124 the actuating rod 200 is swung between the chain-lined positions (somewhat rear of the halting position) in FIG. 11, push rods 207 and 208 correspondingly move horizontally, and, when the halt switch 217 operates in the retreat stroke, actuating rod 200 halts. When actuating operation is required, and push rod 207 or 208, or both, are required to be suspended, corresponding electromagnetic attraction actuator 215 is actuated. FIG. 13 illustrates a situation in which push rod 208 is suspended. By the actuation of actuator 215, pin 211 or 212 (or both) is retracted. In such a way, e.g. as in FIG. 13, an automatic supply of fasteners to upper mold 83 and a manual supply (supplied manually) to the lower mold become possible. In addition, for actuating the push rod in suspension, it is only necessary to cut the circuit of actuator 215 during the suspension of the actuating rod.

Figure 14:
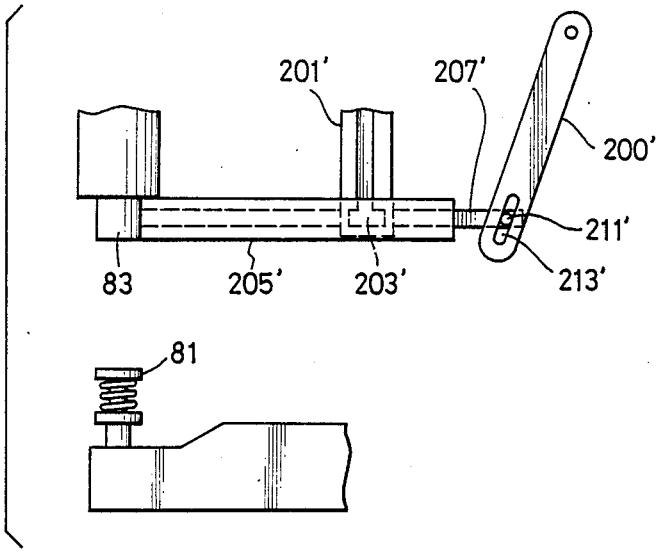
FIG. 14 is a side view according to a third embodiment.
Figure 15:
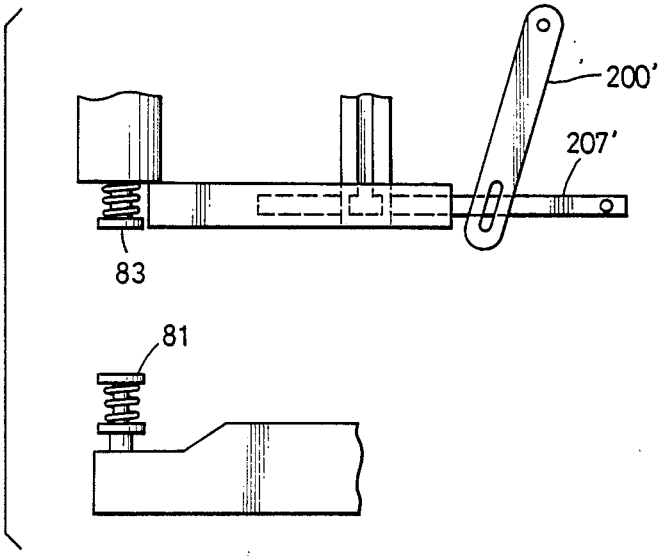
FIG. 15 is a side view illustrating one actuating condition.

FIGS. 14 and 15 illustrate a third embodiment wherein lower mold 81 is of a manual supply type and upper mold 83 is of either an automatic or a manual supply type. Each member is the same as in the upper mold of the second embodiment, and the numerals in the figures correspond to those in FIGS. 11–13, with merely apostrophies added. Further explanation will be omitted. The action of the push rod 207' in the present example is the same as in the preceding example.

We claim:

1. A fastener attaching apparatus comprising:

at least one hopper;

a guide track comprising an outlet and means for discharging a fastener from said hopper through said outlet;

a mold;

a guide groove extending from said outlet toward said mold;

a push rod mounted for slidable movement in said guide groove and comprising means for pushing a fastener from said outlet to a forward position where said fastener enters said mold;

means for withdrawing said push rod from said forward position and for halting said withdrawal at a position where said push rod obturates said outlet; and a power source comprising means for withdrawing said push rod from said obturating position to allow said discharge of a fastener into said guide groove, and for subsequently pushing said fastener to said forward position.

2. A fastener attaching apparatus comprising;

a fixed mold fixed to a base;

a ram mounted for movement toward and away from said fixed mold;

a movable mold fixed to said ram;

pivotally mounted first and second short links operatively connecting said ram to said base for driving said ram toward said fixed mold during an attaching operation;

a crank pivotally mounted to said base and comprising a first leg and a second leg;

a first pulling link operatively connecting said first and second short links to said first leg of said crank such that said first pulling link is primarily in tension during said attaching operation;

a reciprocating motion power source; and a second pulling link operatively connecting said second leg of said crank to said power source such that said second pulling link is primarily in tension during said attaching operation.

3. The apparatus of claim 2, wherein:

said first and second pulling links comprise cross sectional areas sufficient to transmit a compressive force for moving said ram away from said fixed mold.

4. A fastener attaching apparatus comprising:

a plurality of rotatable hoppers;

at least one guide track associated with each of said hoppers and comprising an outlet and means for discharging a fastener from said associated hopper through said outlet;

a guide groove associated with each guide track and extending from said outlet toward an associated mold;

a push rod associated with each guide groove, said push rod being mounted for slidable movement in said guide groove and comprising means for pushing a fastener from said outlet into said associated mold;

a power source associated with each push rod;

at least one reversible hopper power source; and means for alternatively transmitting power from said hopper power source to either of two of said hoppers.

5. The apparatus of claim 4, wherein:

said device comprises two pairs of hoppers;

said hopper power source comprises a reversible electric motor associated with each hopper pair; and said apparatus comprises separate power transmission means interposed between each hopper pair and its associated electric motor.

6. The apparatus of claim 4, wherein:

said reversible hopper power source comprises an electric motor; and said power transmission means comprises means for transmitting power to one of said two hoppers when said electric motor rotates in one direction and means for transmitting power to the other of said hoppers when said electric motor rotates in its reverse direction.

7. The apparatus of claim 6, wherein:

said power transmission means comprises a pair of one-way clutches.

* * * * *